US010450821B2

(12) United States Patent
Guedes et al.

(10) Patent No.: US 10,450,821 B2
(45) Date of Patent: Oct. 22, 2019

(54) WELLHEAD PORT PLUG ASSEMBLY

(71) Applicant: PETROLEUM TECHNOLOGY COMPANY AS, Stavanger (NO)

(72) Inventors: Lino Guedes, Hommersåk (NO); Andre Bolager, Sandnes (NO); Erling Kleppa, Jørpeland (NO); Kristian Harestad, Randaberg (NO); Trond Kvasnes, Sandnes (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 170 days.

(21) Appl. No.: 15/306,396

(22) PCT Filed: Apr. 24, 2015

(86) PCT No.: PCT/EP2015/058880
§ 371 (c)(1),
(2) Date: Oct. 24, 2016

(87) PCT Pub. No.: WO2015/162241
PCT Pub. Date: Oct. 29, 2015

(65) Prior Publication Data

US 2017/0044861 A1 Feb. 16, 2017

(30) Foreign Application Priority Data

Apr. 25, 2014 (NO) ..... 20140536

(51) Int. Cl.
*E21B 33/03* (2006.01)
*E21B 23/02* (2006.01)
(Continued)

(52) U.S. Cl.
CPC ..... *E21B 33/03* (2013.01); *E21B 19/00* (2013.01); *E21B 23/02* (2013.01); *E21B 33/12* (2013.01);
(Continued)

(58) Field of Classification Search
CPC ..... E21B 33/03; E21B 23/02; E21B 33/12; E21B 34/00; E21B 19/00; E21B 34/02; E21B 47/12; E21B 49/08; E21B 2049/085
See application file for complete search history.

(56) References Cited

U.S. PATENT DOCUMENTS

2001/0011593 A1 8/2001 Wilkins
2012/0012341 A1 1/2012 White et al.

FOREIGN PATENT DOCUMENTS

CA 2 461 402 A1 9/2005
WO WO 01/57360 A1 8/2001
(Continued)

*Primary Examiner* — Nicole Coy
(74) *Attorney, Agent, or Firm* — Birch, Stewart, Kolasch & Birch, LLP

(57) ABSTRACT

A wellhead port plug assembly includes a first plug body including connection elements allowing the first plug body to be sealingly and removably mounted in a port of a wellhead of a hydrocarbon well. The plug assembly includes a spool unit displaying an axial through-channel extending between a first end and a second end of the spool unit, which spool unit includes a first flange section arranged at the first end for sealingly mounting the spool unit to the wellhead aligning the through-channel with the port, and a second flange section arranged at the second end; a second plug body including connection elements allowing the second plug body to be sealingly and removably mounted in the through-channel; and a blind flange which is sealingly and removably mounted to the second flange section allowing the second plug body and the first plug body to be removed from the wellhead via the through-channel.

19 Claims, 10 Drawing Sheets

(51) Int. Cl.

| | |
|---|---|
| ***E21B 33/12*** | (2006.01) |
| ***E21B 34/00*** | (2006.01) |
| ***E21B 19/00*** | (2006.01) |
| ***E21B 34/02*** | (2006.01) |
| ***E21B 47/12*** | (2012.01) |
| ***E21B 49/08*** | (2006.01) |

(52) U.S. Cl.
CPC ..... *E21B 34/00* (2013.01); *E21B 34/02* (2013.01); *E21B 47/12* (2013.01); *E21B 49/08* (2013.01); *E21B 2049/085* (2013.01)

(56) References Cited

FOREIGN PATENT DOCUMENTS

| | | |
|---|---|---|
| WO | WO 2006/061645 A1 | 6/2006 |
| WO | WO 2013/056857 A1 | 4/2013 |

WELLHEAD PORT PLUG ASSEMBLY

FIELD OF THE INVENTION

The present invention relates to a wellhead port plug assembly comprising a first plug body comprising connection elements allowing the first plug body to be sealingly and removably mounted in a port of a wellhead of a hydrocarbon well, i.e. an oil and/or gas well.

The invention also relates to a wellhead of a hydrocarbon well comprising such a plug assembly and to a method of replacing the first plug of the plug assembly.

In particular, the invention relates to a method of replacing the first plug without interrupting production of the well.

BACKGROUND

It is common to provide a wellhead of a hydrocarbon well with ports allowing the mounting of devices for monitoring the annuli of the well. For example, such a device is disclosed in WO 2013/056857 A1, which is hereby incorporated by reference. Generally, a system for monitoring an annulus via a wellhead port comprises a plug body which is positioned in the port and comprises at least one sensor for measuring and monitoring at least one parameter in the annulus, e.g. pressure or temperature. In addition to provide a measuring or monitoring function, the plug body must provide a sealing function to prevent leakage to or from the annulus.

US 2012/012341 A1 discloses a wellhead port plug assembly comprising a first plug body which is arranged in an outlet port of the wellhead. The plug assembly further comprises a spool which is aligned with the outlet port. A second plug body is arranged in the spool. The first and second plug bodies can be removed from the well head assembly via the spool upon removal of a blind flange from the spool.

WO 2001/57360 A1 discloses a well data monitoring system which enables annulus pressure and other well parameters to be monitored in the outer annuli of the well casing program without adding any pressure containing penetrations to the well system.

WO 2006/061645 A1 discloses a plug retrieval and installation tool comprising a housing that is lowered on a lift line or riser and connected to subsea production equipment. A plug manipulator which can be extended to install, or retracted to retrieve, a plug-type barrier, is detachably mounted to the housing so that it can be retrieved independently of the housing. The installation tool eliminates the need for full-size intervention vessels or drilling rigs for plug retrieval/installation.

Furthermore, when not utilised for monitoring and measuring purposes, the port must be blocked in order to prevent leakage. This is normally accomplished by positioning a blind plug in the port such that the port is blocked. A blind plug is basically a plug body having no other purpose than to provide a sealing or plugging function.

A problem related to plug bodies positioned in wellhead ports of a hydrocarbon producing well, is that the well need normally to be taken out of production if the plug body is to be replaced. For example, a plug body may occasionally leak, in which case the plug body may need to be substituted for a new plug body. Also, it may be desirable to deploy a monitoring or measuring system in a previously unused port, in which case the blind plug needs to be removed and a plug body comprising a sensor needs to be positioned in its place.

In prior art plug assemblies, the well normally needs to be taken out of production in order for the plug body in the port to be replaced. This, of course, is a major disadvantage in a business where well uptime is paramount.

The present invention addresses this problem and seeks to provide a wellhead port plug assembly and a method allowing replacement of a plug body without having to take the well out of production.

SUMMARY OF THE INVENTION

The plug assembly according to the invention is characterised in that it comprises:

- a spool unit displaying an axial through-channel extending between a first end and a second end of the spool unit, which spool unit comprises a first flange section arranged at the first end for sealingly mounting the spool unit to the wellhead aligning the through-channel with the port, and a second flange section arranged at the second end;
- a second plug body comprising connection elements allowing the second plug body to be sealingly and removably mounted in the through-channel; and
- a blind flange which is sealingly and removably mounted to the second flange section allowing the second plug body and the first plug body to be removed from the wellhead via the through-channel.

The method according to the invention comprises the steps of:

- removing the blind flange from the second flange section;
- mounting a valve to the second flange section and mounting a plug placement and removal tool to the valve aligning the valve and the tool to the port and the through-channel;
- inserting an arm of the tool through the valve, disengaging the second plug body from the spool unit using the arm, and withdrawing the arm and the second plug body through the valve;
- closing the valve;
- detaching the tool from the valve, removing the second plug body from the arm, and reattaching the tool to the valve;
- opening the valve);
- inserting the arm through the valve and the spool unit, disengaging the first plug body from the port using the arm, and withdrawing the arm and the first plug body through the spool unit and the valve;
- closing the valve;
- detaching the tool from the valve, removing the first plug body from the arm, positioning a new first plug body onto the arm, and reattaching the tool to the valve;
- opening the valve;
- inserting the arm and the new first plug body through the valve and the spool unit, mounting the new first plug body inside the port using the arm, and withdrawing the arm through the spool unit and the valve;
- closing the valve;
- detaching the tool from the valve, positioning the second plug body onto the arm, and reattaching the tool to the valve;
- opening the valve;
- inserting the arm and the second plug body through the valve, mounting the second plug body inside the spool unit using the arm, and withdrawing the arm through the valve;

detaching the valve from the second flange section; and reattaching the blind flange to the second flange section.

DESCRIPTION OF THE DRAWINGS

In the following, embodiments of the invention will be disclosed in more detail with reference to the appended drawings.

DETAILED DESCRIPTION OF THE INVENTION

Figure 1:
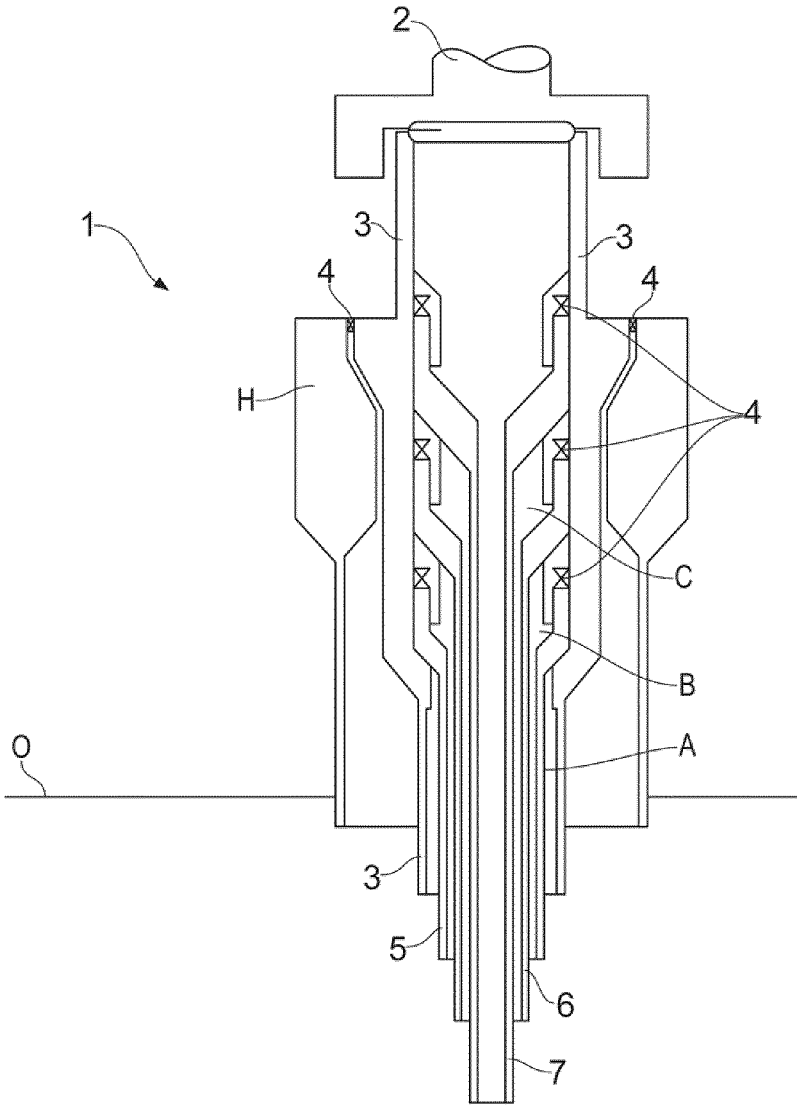
FIG. 1 discloses a wellhead structure of an offshore hydrocarbon well.

FIG. 1 schematically discloses a typical wellhead structure that is used in connection with a hydrocarbon well. The wellhead structure comprises a wellhead 1 which is positioned on a base formation O. The wellhead 1 comprises a housing H and a first casing 3, a second casing 5, a third casing 6 and a fourth 7 casing which extend coaxially a distance down into the base formation O such that a first annular space A, or annulus, is formed between the first casing 3 and the second casing 5, a second annulus B is formed between the second casing 5 and the third casing, and a third annulus is formed C between the fourth casing 6 and the third casing 7. Sealing devices 4, in the form of packers, are arranged between the housing H and the casings 3, 5, 6, 7 such that pressure tight connections between the housing H and the casings 3, 5, 6, 7 are obtained.

When the hydrocarbon well is in production, a production tubing (not disclosed) will be arranged inside the fourth casing 7.

In order to monitor the wellhead 1, i.e. to detect an increased or a decreased of pressure indicative of pressure leaks, at least one plug assembly according to a first embodiment of the invention, which comprises a measuring and monitoring system, is arranged in the wellhead 1 such that well parameters can be measured and monitored. Such parameters may, for example, include the pressure and/or the temperature in one of annuli A-C of the wellhead 1. The wellhead 1 will then be configured with a through-bore or channel (not disclosed in FIG. 1) leading into the annulus to be monitored, to which channel the plug assembly is connected.

In order to get a more complete overview of the performance of the well, it may be advantageous to provide the wellhead 1 with more than one plug assembly, e.g. one plug assembly for each annulus.

The measurements made by the measuring and monitoring system may advantageously be transmitted to an external location for processing and analysis.

Figure 2:
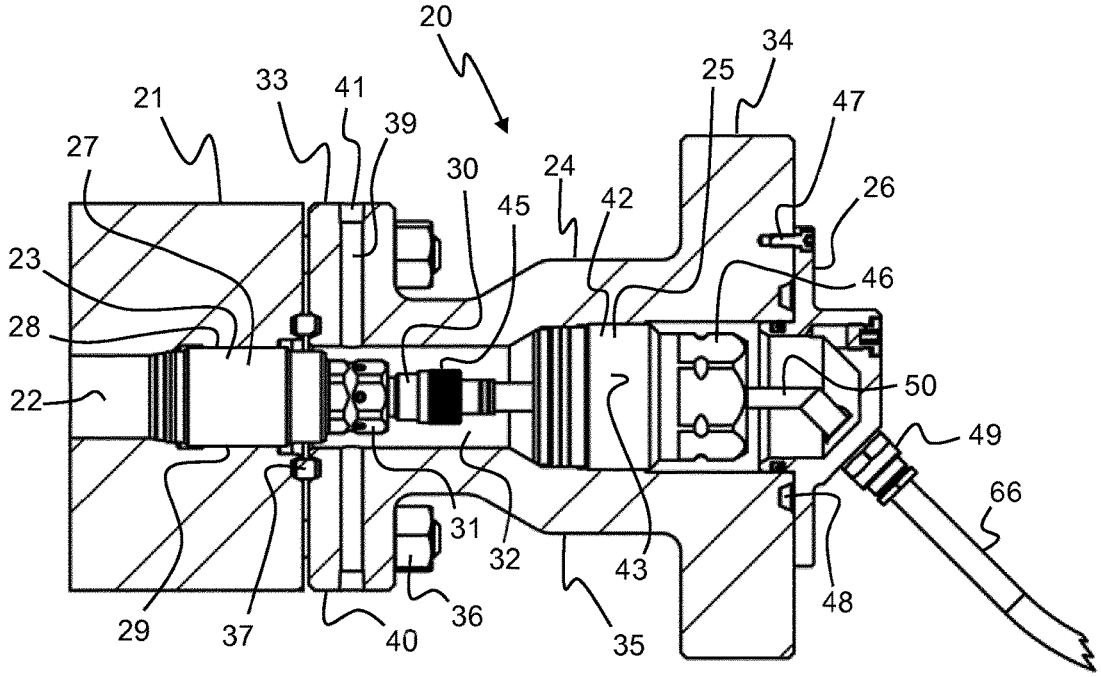
FIG. 2 discloses a sectional side view of an embodiment of a plug assembly according to the present invention mounted to a wellhead, which plug assembly comprises a measuring or monitoring system.

FIG. 2 discloses an embodiment of a plug assembly 20 according to the invention comprising a measuring or monitoring system. The assembly 20 is mounted to a wellhead 21 which comprises a bore or channel 22 leading to an annulus of the wellhead 21. An outermost section 22*b* of the channel 22 forms an opening or port of the channel 22 and has a diameter which is slightly larger than a neighbouring section 22*a* such that an annular shoulder 19 is formed within the channel (cf. FIG. 10).

The assembly 20 comprises a first unit 23, a spool unit 24, a second unit 25 and a blind flange 26. In the present embodiment, the first and second units 23, 25 are sensor units.

The first sensor unit 23 comprises a plug body 27 which has a generally cylindrical form and comprises at least one sensor 18 (cf. FIG. 3) for measuring a physical parameter related to a fluid in the channel 22. Such sensors are known as such and will not be discussed further here. As is known in the art, the parameters may comprise temperature and pressure. The plug body 27 comprises external threads 28 for cooperation with corresponding internal threads 29 of the channel 22 (cf. FIG. 10). The plug body 27 is threaded into the channel 22 and abuts the shoulder 19 (cf. FIG. 10) such that a fluid-tight metal-to-metal connection or seal is formed between the plug body 27 and the inside wall of the channel 22. The assembly 20 further comprises a connector element 30 for connecting the first sensor unit 23 to the second sensor unit 25 such that electrical signals can be transmitted between the units 23 and 25. The first sensor unit 23 also comprises a tool engagement element 31 for cooperation with a plug installation and removal tool (to be discussed below).

The spool unit 24 displays a through-bore or channel 32 which runs in the longitudinal or axial direction between a first end 24*a* and a second end 24*b* of the spool unit 24. The spool unit 24 comprises a housing 35 which is generally circular symmetric about the longitudinal axis of the spool unit 24. At the first end 24*a*, the housing 35 comprises a first flange section 33, and at a second end 24*b* the housing comprises a second flange section 34. The first flange section 33 is connected to the wellhead 21 by means of fastening means in the form of bolts 36 such that the channel 32 of the spool unit 24 is coaxial with the channel 22 of the wellhead 21. An annular sealing element 37 is positioned between the first flange portion 33 and the wellhead 21 to ensure a fluid-tight connection between the spool unit 23 and the wellhead 21. A first section 32*a* of the channel 32, which faces towards the wellhead 21, has a diameter which is less than a second section 32*b* facing away from the wellhead 21 such that that an annular shoulder 38 is formed within the channel 32 (cf. FIG. 10). The diameter of the spool unit channel section 32*a* is generally the same as the diameter of the wellhead channel section 22*b*. The first flange section 33 comprises radial, through-bores or channels 39 connecting the channel section 32*a* with an outer, annular surface 40 of the first flange section 33. Theses channels 39 may be used to provide a fluid communication conduit to the channel 32, e.g. to monitor the pressure in or vent the channel section 32*a*, but are plugged by plugging elements or valves 41 at the outer surface 40 when not in operation.

The second sensor unit 25 comprises a plug body 42 which has a generally cylindrical form and comprises electronics for receiving signals from the sensors of the first plug body 27 and forwarding the signals to a signal transmission unit of the assembly (to be discussed below). The unit 25 may also comprise electronics for processing the signals prior to forwarding them, and electronics for communicating with the sensors. The plug body 42 comprises external threads 43 for cooperation with corresponding internal threads 44 of the channel 32 (cf. FIG. 10). The plug body 27 is threaded into the channel 22 and abuts the shoulder 38 (cf. FIG. 10) such that a fluid-tight metal-to-metal connection or seal is formed between the plug body 44 and the inside wall of the channel 32. The second sensor unit 25 further comprises a connector element 45 for connecting the second sensor unit 25 to the first sensor unit 23 such that electrical signals can be transmitted between the sensor units 23, 25. In the disclosed embodiment, the connection element 45 of the second sensor unit 25 is connected to the connector element 30 of the first sensor unit 23 by means of an axial release coupling, i.e. a coupling which allows the connector element 45 to be connected and disconnected from the first connector element 30 upon a movement of the second connector element 45 in the longitudinal or axial direction of the spool unit 24. The second sensor unit 45 also comprises a tool engagement element 46 for cooperation with the above-mentioned plug installation and removal tool (to be discussed below).

The blind flange 26 is connected to the second flange section 34 of the spool unit 24 by means of fastening means in the form of bolts 47. An annular sealing element 48 is positioned between the blind flange 26 and the second flange section 34 to ensure a fluid-tight connection between the spool unit 23 and the blind flange 26. The blind flange 26 comprises a lead-through 49 which, on the inside of the blind flange 26, comprises a connector element 50 which is connected to a corresponding connector element (not disclosed) of the second sensor unit 25. The connector element 50 is connected to the unit 25 by means of an axial release coupling, i.e. a coupling which allows the connector element 50 to be connected and disconnected from the second sensor unit 25 upon a movement of the connector element 50 in the longitudinal or axial direction of the spool unit 24. On the outside of the blind flange 26, the lead-through 49 is connected to a signal transmission unit 66 for forwarding the signals to said external location. In the disclosed embodiment, the signal transmission unit 66 comprises a communication cable. Power for operating the sensors and the sensor electronics may be provided to the assembly 20 via the same cable 66. In an alternative embodiment (not disclose), the sensor signals are transmitted wirelessly to the external location. In such an embodiment, the cable may be substituted for wireless transmission means such as an antenna which advantageously is positioned on the outside surface of the blind flange. Also, in such an embodiment, a power supply, e.g. an electric battery, is advantageously arranged in the assembly, e.g. in the second sensor unit 24, to provide power to the sensors and to the associated electronics and signal transmission means.

The plug bodies 27 and 42 provide two independent barriers against the channel 22 and, consequently, against the annulus the assembly 20 is set to monitor. Should the spool unit 24 be knocked of the wellhead 21, e.g. due to a falling load hitting the spool unit 24, the connector elements 30 and 45 will separate and the first plug body will remain in the channel 22, thus preventing fluid in the annulus from escaping via the channel 22.

The spool unit and blind flange assembly enables the first sensor unit 23 and/or the second sensor unit 25 to be substituted while maintaining production in the well. In the following, a method of substituting the first sensor unit 23 while maintaining the pressure integrity of the wellhead 21 will be disclosed.

Figure 3:
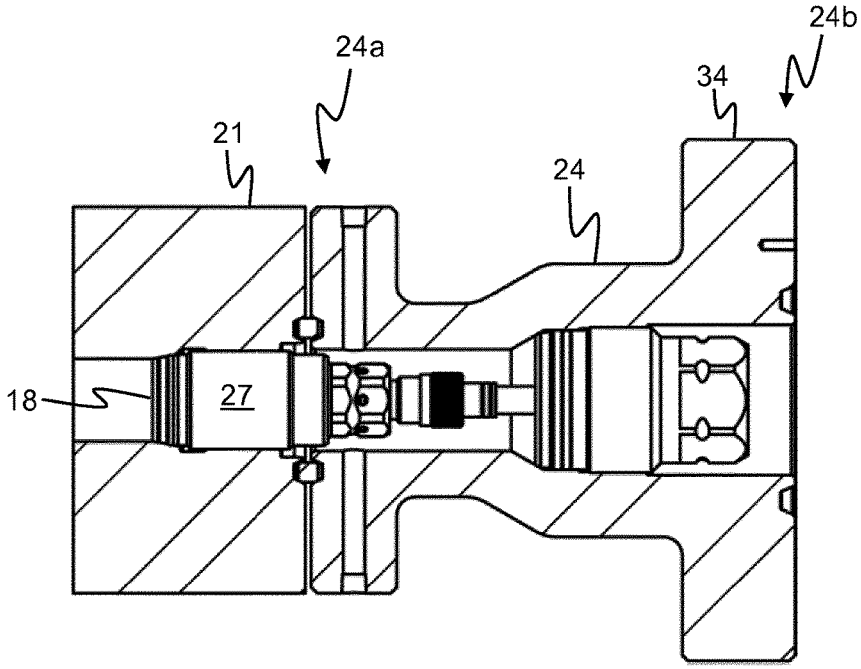
FIG. 3 discloses the assembly according to FIG. 2 wherein a blind flange of the assembly has been removed.

The first step of the method comprises removing the blind flange 26 from the second flange section 34 of the spool unit 24. When moving the blind flange 26 away from the second flange section 34 in the longitudinal or axial direction of the spool unit 24, the connector element 50 will automatically release from the second sensor unit 25 due to the axial release coupling between the connector element 50 and the sensor unit 25. FIG. 3 discloses the assembly 20 when the blind flange has been removed form the spool unit 24. At this stage, the plug bodies 27, 42 still act as a dual barrier against the annulus.

Figure 4:
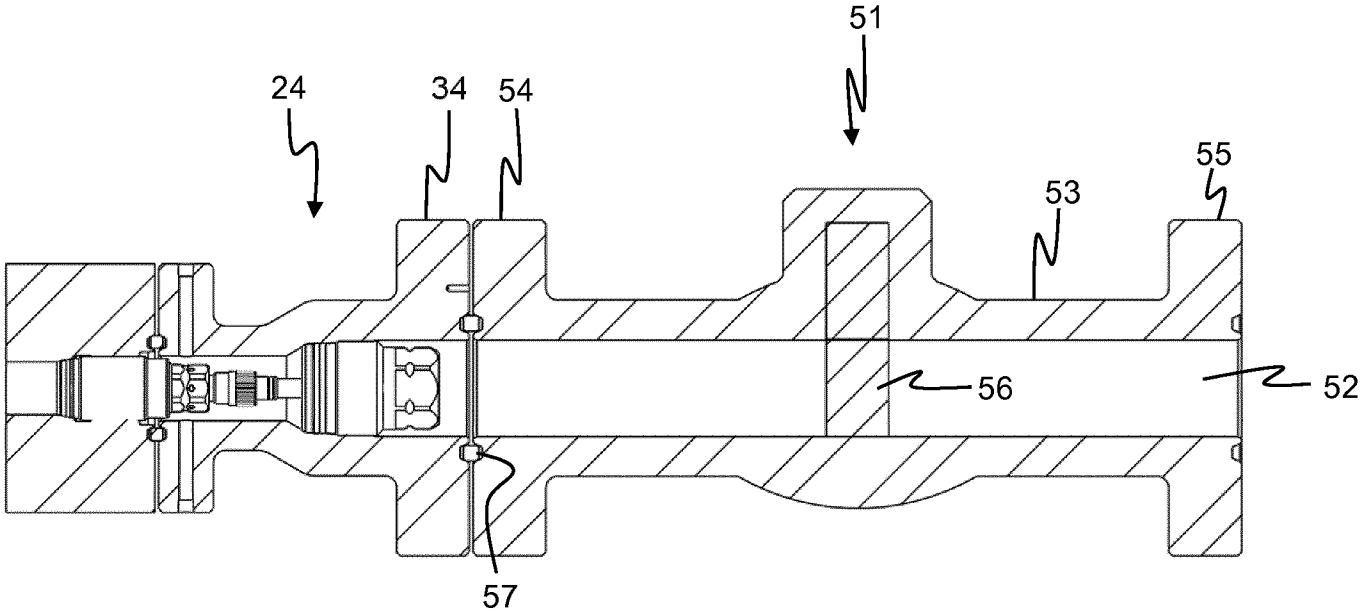
FIG. 4 discloses the assembly according to FIG. 3 with a gate valve mounted the assembly.

The next step comprises attaching a valve 51, e.g. a gate valve, to the spool unit 24, as is disclosed in FIG. 4. The valve 51 displays a through-bore or channel 52 and comprises an elongated housing 53. At one end, the housing 53 comprises a first flange section 54, and at the other end the housing 53 comprises a second flange section 55. Inside the housing 53, the valve 51 comprises a valve body 56, which is operable between a first, closed position in which the valve body 56 blocks the channel 52 providing a fluid-tight seal therein, and a second, open position in which the valve body 56 is retracted in the housing 53 such that it does not restrict the channel 52. The channel 52 generally displays the same diameter as the outermost channel section 32*b* of the spool unit 24, and the first flange section 53 of the valve 51 is connected to the second flange section 34 of the spool unit 24 such that the channels 32 and 52 are coaxial. An annular sealing element 57 is positioned between the flange sections 34 and 54 to ensure that a fluid-tight connection is formed between the spool unit 24 and the valve 51.

Figure 5:
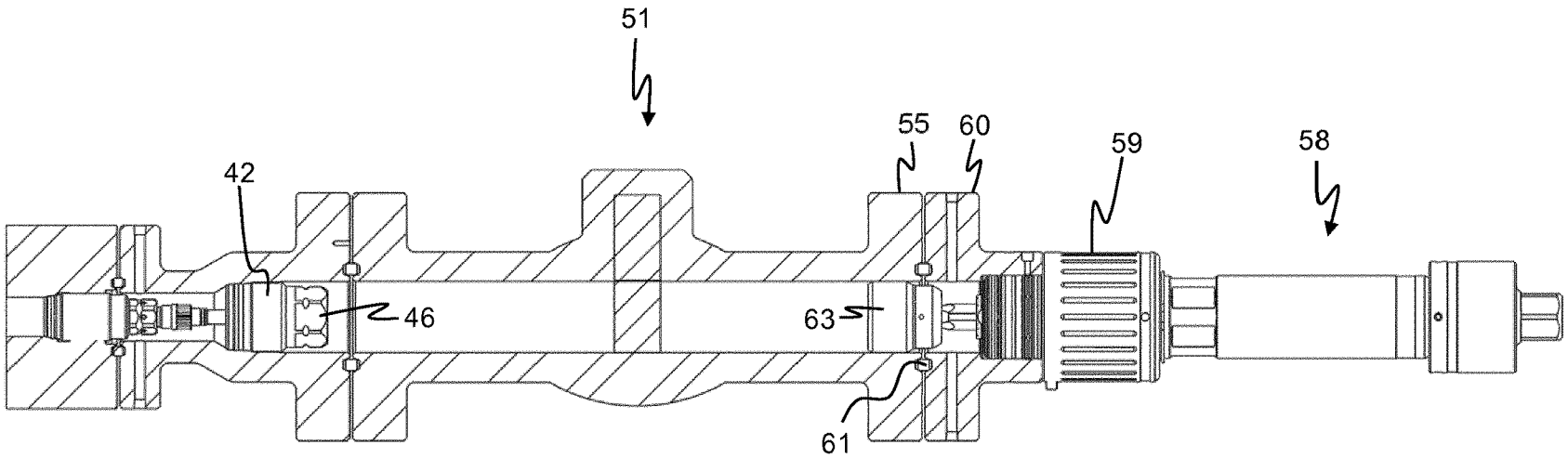
FIG. 5 discloses the assembly and gate valve according to FIG. 4 with a plug placement and removal tool mounted to the valve.

The next step comprises attaching a plug placement and removal tool 58 to the valve 51, as is disclosed in FIG. 5. The tool 58 may be of the type disclosed in WO 2011/093717A2, which is hereby incorporated by reference. The tool 58 comprises an elongated housing 59, which comprises a flange section 60 allowing the tool 58 to be attached to the second flange section 55 of the valve 51. An annular sealing element 61 is positioned between the flange sections 55 and 60 to ensure that a fluid-tight connection is formed between the valve 51 and the tool 58. The tool 58 comprises an extendable and rotatable arm 62 which, in the disclosed embodiment, comprises a first, outer arm section 62*a* and a second, inner arm section 62*b* which is telescopically movable within the outer arm section 62*a* (cf. FIG. 6). At the outer end of the inner arm section 62*b*, there is attached an interchangeable plug engagement element 63 which is compatible with the tool engagement element 46 of the second plug body 42.

Figure 6:
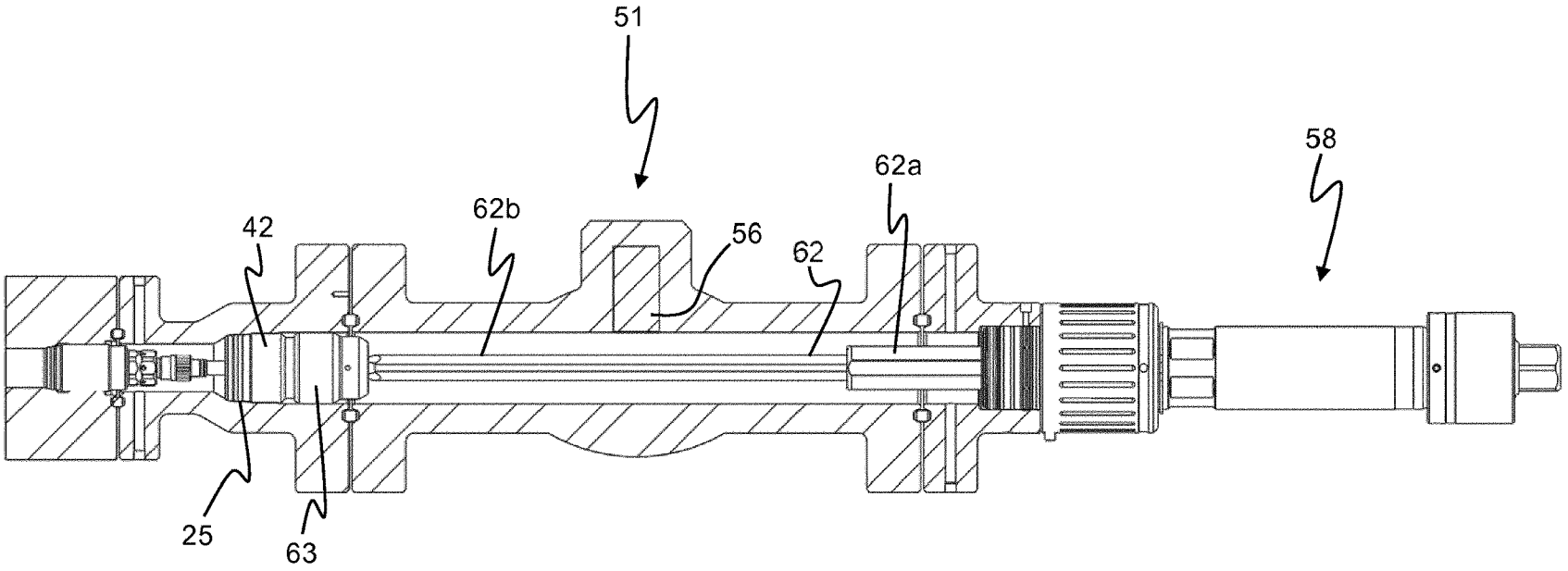
FIGS. 6-10 disclose the assembly, gate valve and tool according to FIG. 5 during replacement of a plug body of the assembly.

When the tool 58 has been connected to the valve 51, the valve 51 is opened by bringing the valve body 56 to the open position and the arm 62 is extended such that the plug engagement element 63 is brought into contact with and connects to the tool engagement element 42 of the second sensor unit 25, as is disclosed in FIG. 6. Thereafter, the arm 62 is brought to rotate such that the threaded engagement between the external threads 43 of the second plug body 42 and the internal threads 44 of the channel 32 (cf. FIG. 10) is disengaged.

Thereafter, the arm 62 and the attached second sensor unit 25 are retracted in the longitudinal or axial direction of the spool unit 24 such that the connector element 45 is released from the connector element 30 due to the axial release coupling between the connector elements 30 and 45. The arm 62 and the attached second sensor unit 25 are then withdrawn through the valve 51, whereafter the valve body 56 is brought to its closed position, as is disclosed in FIG. 7.

Figure 8:
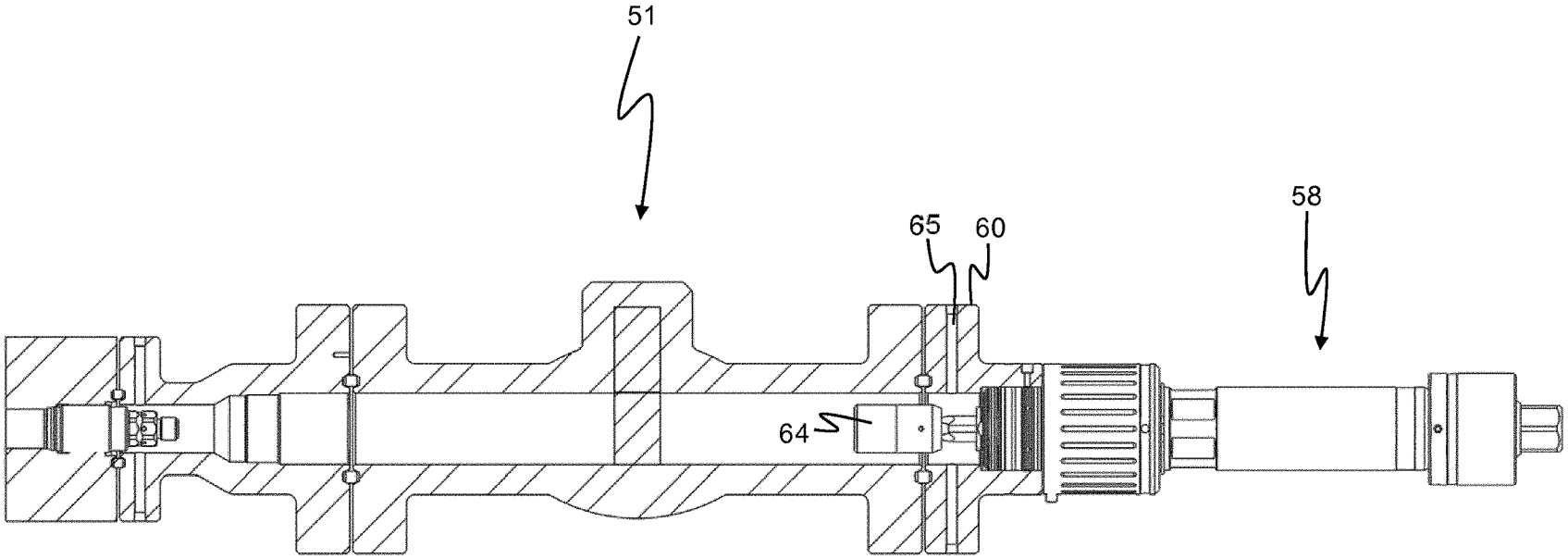

The next step comprises detaching the tool 58 from the valve 51, removing the second sensor unit 25 from the arm 62, substituting the first plug engagement element 63 for a second plug engagement element 64 which is compatible with the tool engagement element 31 of the first sensor unit 23, and reattaching the tool 58 to the valve 51, as is disclosed in FIG. 8. Prior to detaching the tool 58 from the valve 51, the tool 58 may be vented via through-bores or channels 65 in the flanges section 60 of the tool 58.

Figure 9:
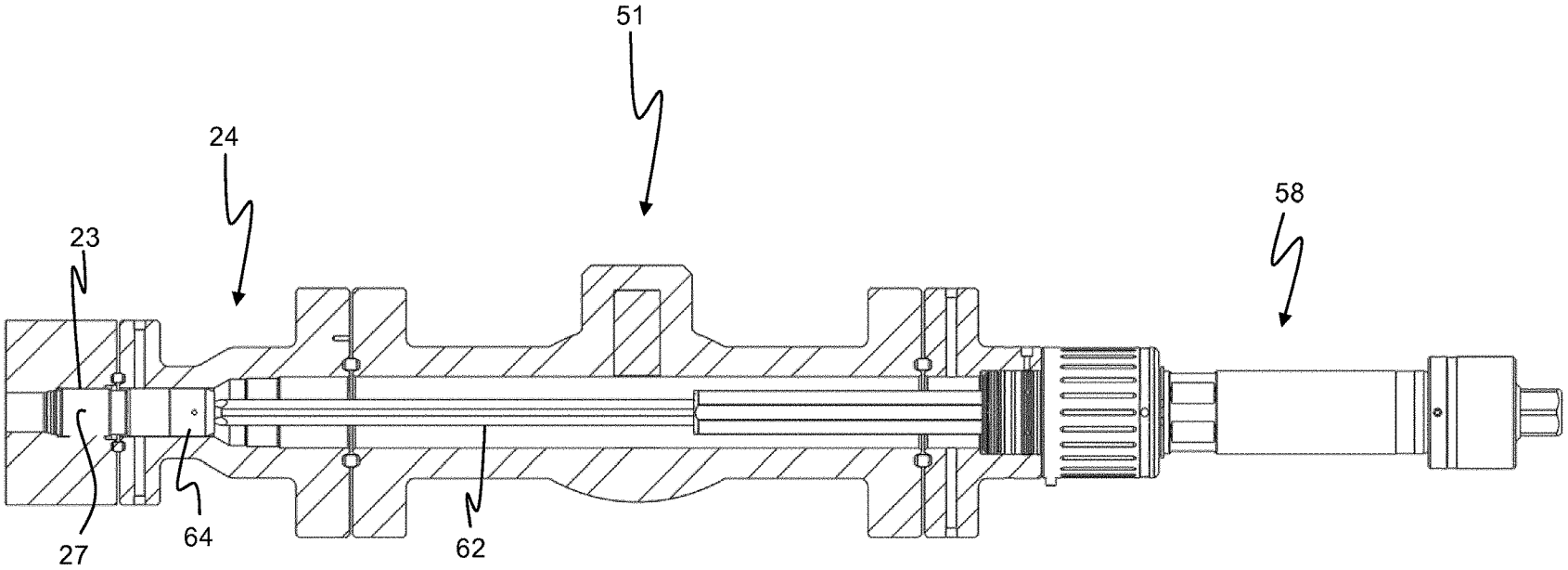

Next, the valve 51 is once again opened by bringing the valve body 56 to the open position and the arm 62 is extended through the valve 51 and the spool unit 24 such that the plug engagement element 64 is brought into contact with and connects to the tool engagement element 31 of the first sensor unit 23, as is disclosed in FIG. 9. The plug engagement element 64 comprises an axial recess (not visible) for accommodating the connector element 30 (cf. FIG. 2). Thereafter, the arm 62 is brought to rotate such that the threaded engagement between the external threads 28 of the first plug body 27 and the internal threads 29 of the channel 22 (cf. FIG. 10) is disengaged.

Figure 10:
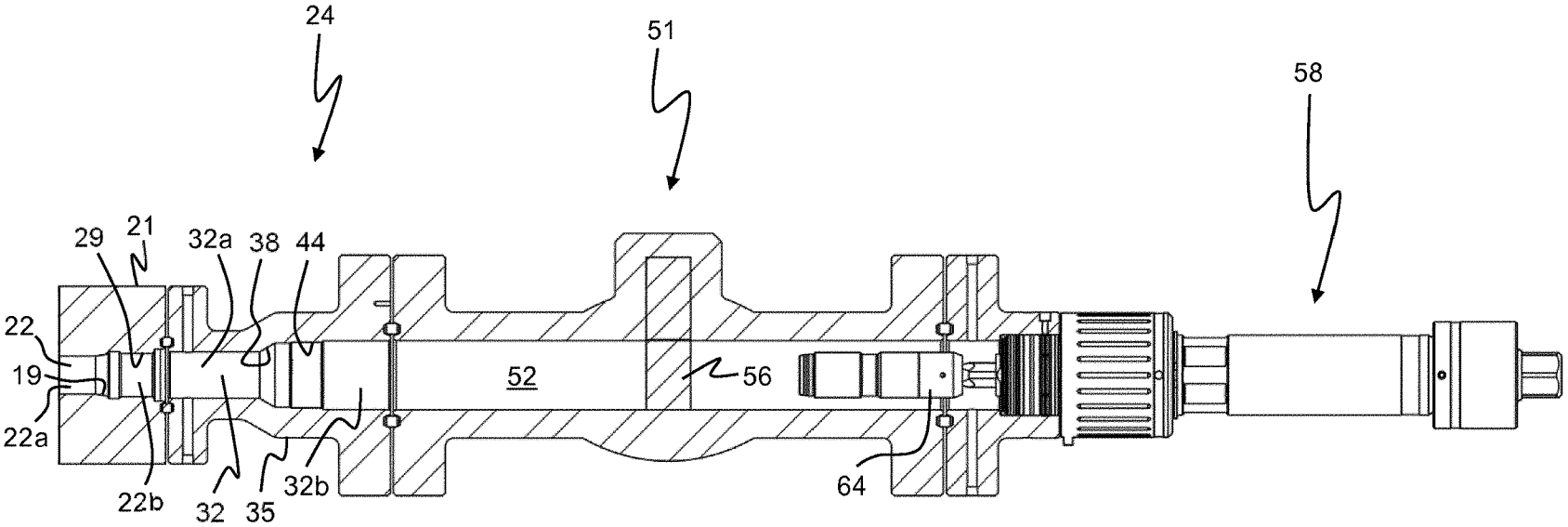

Thereafter, the arm 62 and the attached first sensor unit 23 are retracted in the longitudinal or axial direction of the spool unit 24 through the spool unit 24 and the valve 51, as is disclosed in FIG. 10, whereafter the valve body 56 is brought to its closed position.

Next, the tool 58 is detached from the valve 24 and the first sensor unit 23 to be replaced is removed from the plug engagement element 64. Thereafter, a new first sensor unit is attached to the plug engagement element 64 and the tool 58 is reattached to the valve 51.

Next, the above-disclosed steps are performed in reversed order, i.e.:

- the valve body 56 is brought to its open position,
- the arm 62 is extended through the valve 51 and the spool unit 24 such that the external threads 28 of the plug body 27 is brought into contact with the internal threads 29 of the channel 22,
- the arm 62 is brought to rotate such that a fluid-tight, threaded engagement is created between the threads 28 and 29,
- the arm 62 is retracted through the spool unit 24 and the valve 51 leaving the first sensor unit 23 in the channel 22,
- the valve body 56 is brought to its closed position,
- the tool 58 is detached from the valve 51 and the plug engagement element 64 is substituted for the plug engagement element 63,
- the second sensor unit 25 is attached to the plug engagement element 63 and the tool 58 is reattached to the valve 51,
- the valve body 56 is brought to its open position
- the arm 62 is inserted through the valve 51 and into the spool unit 24 such that the connector element 45 of the second sensor unit 25 is brought to connect to the connector element 30 of the first sensor unit 23,
- the arm 62 is brought to rotate such that a fluid-tight, threaded engagement is created between the external threads 43 of the plug body 42 and the internal threads 44 of the channel 32,
- the arm is retracted through the valve 51 leaving the second sensor unit 25 in the spool unit 24,
- the tool 58 is detached from the valve 51,
- the valve 51 is detached from the spool unit 24, and
- the blind flange 26 is sealingly reattached to the spool unit 24 such that the connector element 50 is connected to the second sensor unit 25.

Figure 11:
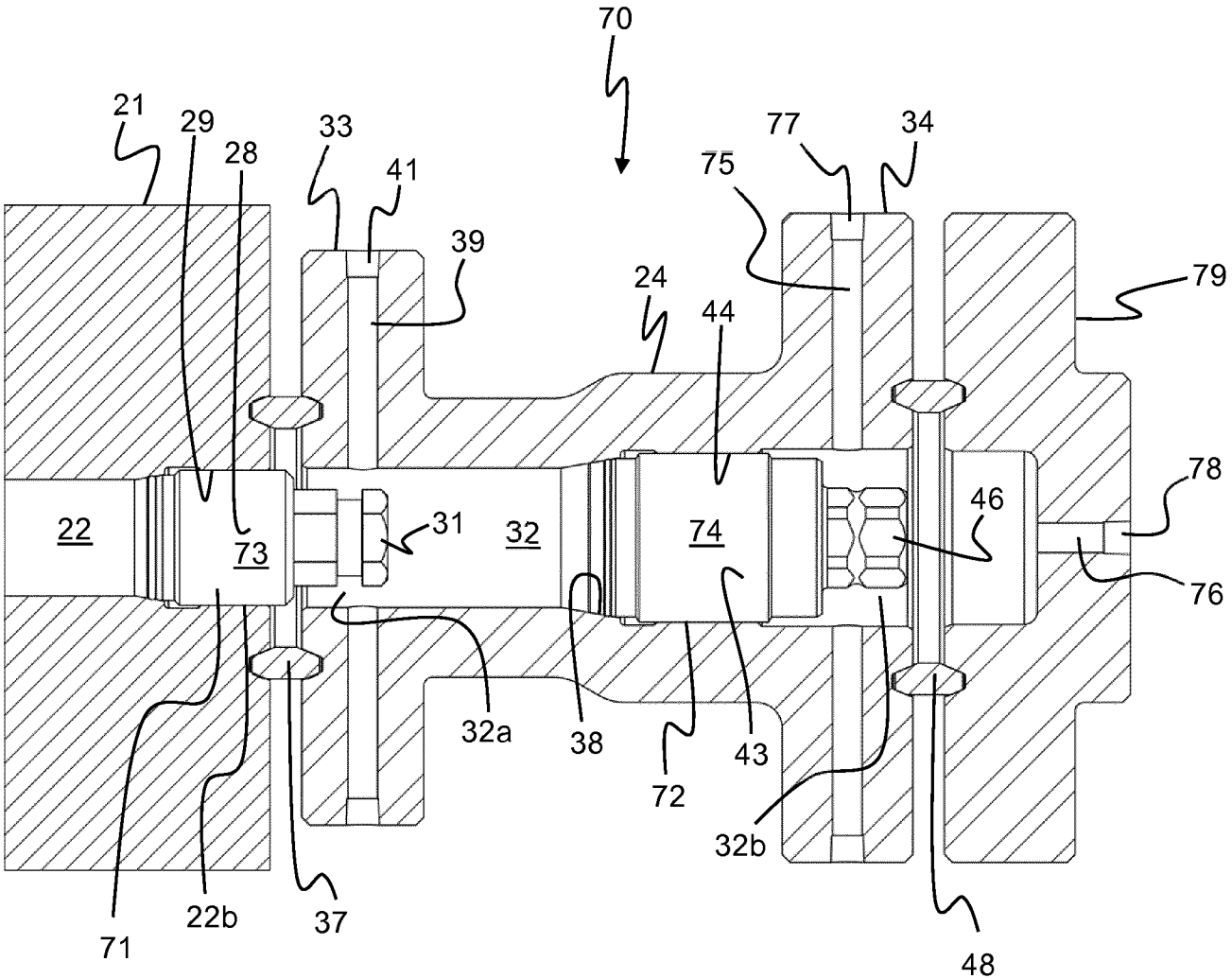
FIG. 11 discloses a sectional side view of a second embodiment of a plug assembly according to the present invention mounted to a wellhead.

When a through-bore or channel leading into one of the annuli A-C of the wellhead 1 is not utilised for monitoring purposes, the through-bore or channel may need to be plugged in order to prevent leakage. FIG. 11 discloses a second embodiment of a plug assembly 70 according to the invention which provides such a plugging function while enabling substitution of plug bodies of the assembly without requiring the hydrocarbon well to be taken out of production.

The general structure of this second embodiment of the assembly 70 is generally the same as the above-disclosed first embodiment 20 and like parts have been denoted like reference numerals.

The assembly 17 comprises a first unit 71, a spool unit 24, a second unit 72 and a blind flange 79. However, in this case the first and second units 71 and 72 are not sensor units but blinds, each comprising a plug body 73, 74 arranged to provide a sealing function but not a monitoring or measuring function. Consequently, the assembly 70 lacks the monitoring and measuring features of the first assembly 20, e.g. connector elements corresponding to the connector elements 45 and 50, a signal transmission unit etc.

The first plug body 73 is positioned in the outermost section **22*b* of the wellhead channel 22, and the second plug body 74 is positioned in the though channel 32 of the spool unit 24. Consequently, the plug bodies 73, 74 form a double plug barrier preventing leakage from the wellhead channel 22. Furthermore, even if the spool unit 24 should be damaged, e.g. knocked of the wellhead 21 by a falling load, the first plug body 73 will remain in the wellhead channel 22 and prevent uncontrolled leakage from the channel 22**.

Figure 7:
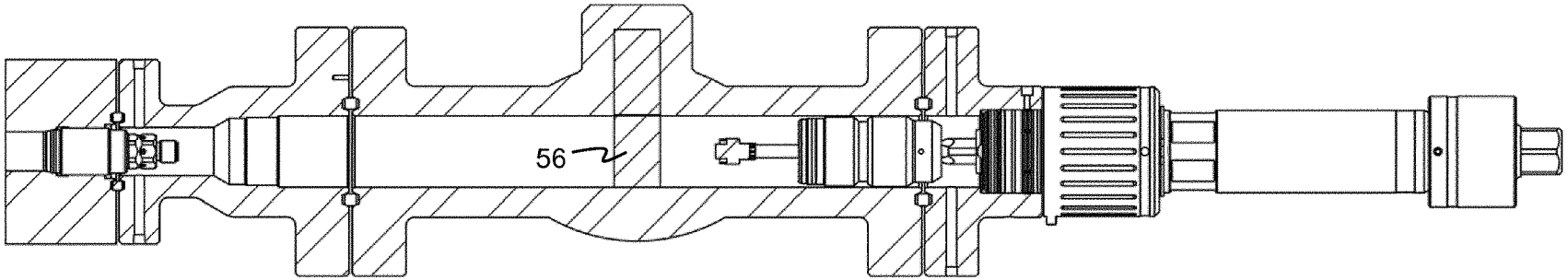

The method of substituting the first plug body 73 is generally the same as the above-disclosed method of substituting the plug body 27, i.e. it comprises the steps of:

- removing the blind flange 79 from the second flange section 34;
- mounting a valve 51 to the second flange section 34 and mounting a plug placement and removal tool 58 to the valve 51 aligning the valve 51 and the tool 58 to the port 22 and the through-channel 32 in the same manner as is disclosed in FIG. 5;
- inserting an arm 62 of the tool 51 through the valve 51, disengaging the second plug body 74 from the spool unit 24 using the arm 62, and withdrawing the arm 62 and the second plug body 74 through the valve 51 in the same manner as is disclosed in FIGS. 6 and 7;
- closing the valve 51 in the same manner as is disclosed in FIG. 8;
- detaching the tool 58 from the valve 51, removing the second plug body 74 from the arm 62, and reattaching the tool 58 to the valve 51;
- opening the valve 51;
- inserting the arm 62 through the valve 51 and the spool unit 24, disengaging the first plug body 73 from the port 22 using the arm 62, and withdrawing the arm 62 and the first plug body 73 through the spool unit 24 and the valve 51 in the same manner as is disclosed in FIGS. 9 and 10;
- closing the valve 51;
- detaching the tool 58 from the valve 51, removing the first plug body 73 from the arm 62, positioning a new first plug body onto the arm 62, and reattaching the tool 58 to the valve 51;

opening the valve 51;

inserting the arm 62 and the new first plug body through the valve 51 and the spool unit 24, mounting the new first plug body inside the port 22 using the arm 62, and withdrawing the arm 62 through the spool unit 24 and the valve 51;

closing the valve 51;

detaching the tool 58 from the valve 51, positioning the second plug body 74 onto the arm 62, and reattaching the tool 58 to the valve 51;

opening the valve 51;

inserting the arm 62 and the second plug body 74 through the valve 51, mounting the second plug body 74 inside the spool unit 24 using the arm 62, and withdrawing the arm 62 through the valve 51;

detaching the valve 51 from the second flange section 34; and reattaching the blind flange 79 to the second flange section 34.

For co-operating with the plug engagement elements 63, 64 of the tool 58 (see FIGS. 6 and 9), the plug bodies 73, 74 comprise tool engagement elements 31, 46. As the above-disclosed plug bodies 27 and 42, the plug bodies 73 and 74 may advantageously comprise external threads 28, 43 for co-operation with corresponding internal threads 29, 44 of the outlet 22 and the channel 32, respectively. Consequently, the steps comprising disengaging the plug bodies 73, 74 from the channel 22 and the spool unit 24, respectively, and mounting the plug bodies 73, 74 to the channel 22 and the spool unit 24, respectively, may comprise rotating the arm 62 about the longitudinal axis of the tool 58.

In an alternative embodiment, it may be advantageous to rotate only the plug engagement element 63, 64, which is attached to the outer end of the arm 62, about the longitudinal axis.

As the spool unit of the first plug assembly 20 (see FIGS. 2-10), the first flange section 33 of the assembly 70 comprises a through-bore or channel 39 enabling pressure probing and/or venting of the channel section 32*a* of the spool unit 24. However, it may be advantageous to provide also the second flange section 34 with a through-bore or channel 75, enabling pressure probing and/or venting also of the channel section 32*b*, i.e. on the outside of the second plug body 74. Furthermore, it may be advantageous to provide the blind flange 79 with a corresponding through-bore or channel 76. As the above-disclosed channel 39, the channels 75 and 76 are advantageously plugged by plugging elements or valves 77, 78 when not in operation.

The channels 39, 75 and 76 may be utilised at any one of above-disclosed steps, e.g. to verify the integrity of the plug assembly. For example, any one of channels 75 and 76 may be utilised to verify the integrity of the second unit 72 prior to removing the blind flange 26.

In the preceding description, various aspects of the assembly according to the invention have been described with reference to the illustrative embodiment. For purposes of explanation, specific numbers, systems and configurations were set forth in order to provide a thorough understanding of the assembly and its workings. However, this description is not intended to be construed in a limiting sense. Various modifications and variations of the illustrative embodiment, as well as other embodiments of the assembly, which are apparent to persons skilled in the art to which the disclosed subject matter pertains, are deemed to lie within the scope of the present invention. For example, instead of first attaching the valve 51 to the spool unit 24 and then attaching the tool 58 to the valve, the skilled person readily understands that a possible alternative is to first attach the tool 58 to the valve 51 and then attach the valve-spool assembly to the spool unit 24. Also, after completion of the substitution of the first sensor unit, the valve 51 and the tool 58 may be removed in the same manner.

The invention claimed is:

1. A wellhead port plug assembly, comprising:

a first plug body comprising threads allowing the first plug body to be sealingly and removably mounted in a port of a wellhead of a hydrocarbon well;

a spool unit being a unitary member including an axial through-channel extending between a first end and a second end of the spool unit, said spool unit comprising:

a first flange arranged at the first end for sealingly mounting the spool unit to the wellhead aligning the through-channel with the port; and a second flange arranged at the second end;

a second plug body comprising threads allowing the second plug body to be sealingly and removably mounted in the through-channel; and a blind flange covering an entirety of the axial through-channel at the second end of the spool unit and being sealingly and removably mounted to the second flange, said blind flange allowing the second plug body and the first plug body to be removed from the wellhead via the through-channel while the spool unit remains connected to the wellhead, wherein the first plug body includes a sensor configured to measure temperature and pressure of fluid in the axial-through channel, and wherein the blind flange includes a lead-through connected to a signal transmission member having a communication cable, the signal transmission member forwarding signals from the sensor to an external location.

2. The wellhead port plug assembly according to claim 1, wherein each of said first plug body and said second plug body comprises a tool engagement element for co-operation with a plug placement and removal tool.

3. The wellhead port plug assembly according to claim 1, wherein at least one of the first flange and the second flange comprises a through-bore providing a fluid communication conduit leading into the through-channel of the spool unit.

4. The wellhead port plug assembly according to claim 1, wherein the through-channel comprises an annular shoulder for co-operation with the second plug body for providing a metal-to-metal seal between the spool unit and the second plug body.

5. The wellhead port plug assembly according to claim 4, wherein the through-channel of the spool unit comprises a first channel section and a second channel section, and wherein the diameter of the second channel section is larger than the diameter of the first channel section.

6. The wellhead port plug assembly according to claim 5, wherein the diameter of the first channel section is sufficient to allow the transport of the first plug body therethrough.

7. The wellhead port plug assembly according to claim 1, wherein the first plug body comprises electronics for receiving signals from the sensor.

8. The wellhead port plug assembly according to claim 1, wherein the plug assembly comprises a signal transmission unit for forwarding the signals to a location separate from the plug assembly.

9. The wellhead port plug assembly according to claim 8, wherein the signal transmission unit comprises a communication cable.

10. The wellhead port plug assembly according to claim 8, wherein the signal transmission unit comprises wireless transmission means.

11. The wellhead port plug assembly according to claim 1, wherein the plug assembly comprises a power supply to provide power to the sensor.

12. A method of replacing a first plug of the wellhead port plug assembly according to claim 1, comprising the steps of:

removing the blind flange from the second flange;

mounting a valve to the second flange and mounting a plug placement and removal tool to the valve aligning the valve and the tool to the port and the through-channel;

inserting an arm of the tool through the valve, disengaging the second plug body from the spool unit using the arm, and withdrawing the arm and the second plug body through the valve;

closing the valve;

detaching the tool from the valve, removing the second plug body from the arm, and reattaching the tool to the valve;

opening the valve;

inserting the arm through the valve and the spool unit, disengaging the first plug body from the port using the arm, and withdrawing the arm and the first plug body through the spool unit and the valve;

closing the valve;

detaching the tool from the valve, removing the first plug body from the arm, positioning a new first plug body onto the arm, and reattaching the tool to the valve;

opening the valve;

inserting the arm and the new first plug body through the valve and the spool unit, mounting the new first plug body inside the port using the arm, and withdrawing the arm through the spool unit and the valve;

closing the valve;

detaching the tool from the valve, positioning the second plug body onto the arm, and reattaching the tool to the valve;

opening the valve;

inserting the arm and the second plug body through the valve, mounting the second plug body inside the spool unit using the arm, and withdrawing the arm through the valve;

detaching the valve from the second flange; and reattaching the blind flange to the second flange.

13. The method according to claim 12, wherein at least one of the steps of disengaging the second plug body from the spool unit and mounting the second plug body to the spool unit comprises rotating the arm about the longitudinal axis of the tool.

14. The method according to claim 12, wherein at least one of the steps of disengaging the first plug body from the port and mounting the first plug body inside the port comprises rotating the arm about the longitudinal axis of the tool.

15. A wellhead of a hydrocarbon well, comprising the wellhead port plug assembly according to claim 1.

16. The wellhead according to claim 15, wherein the port is in fluid communication with a channel leading to a well annulus.

17. The wellhead port plug assembly according to claim 1, wherein the second flange has a greater diameter than the first flange.

18. The wellhead port plug assembly according to claim 1, wherein the blind flange has a connector directly connected to a connector of the second plug body.

19. A wellhead port plug assembly, comprising:

a first plug body comprising threads allowing the first plug body to be sealingly and removably mounted in a port of a wellhead of a hydrocarbon well the first plug body comprising at least one sensor for measuring a physical parameter;

a stool unit being a unitary member including an axial through-channel extending between a first end and a second end of the spool unit, said spool unit comprising:

a first flange arranged at the first end for sealingly mounting the spool unit to the wellhead aligning the through-channel with the port; and a second flange arranged at the second end;

a second plug body comprising threads allowing the second plug body to be sealingly and removably mounted in the through-channel; and a blind flange covering an entirety of the axial through-channel at the second end of the spool unit and being sealingly and removably mounted to the second flange, said blind flange allowing the second plug body and the first plug body to be removed from the wellhead via the through-channel while the spool unit remains connected to the wellhead, wherein the blind flange has a connector directly connected to a connector of the second plug body.

* * * * *